US006009931A

United States Patent [19]

Peterson

[11] Patent Number: 6,009,931

[45] Date of Patent: Jan. 4, 2000

[54] MODULAR HORIZONTAL WINDOW BLIND

[76] Inventor: James M. Peterson, 3107 N. Broadmoor, San Bernardino, Calif. 92408

[21] Appl. No.: 09/151,547

[22] Filed: Sep. 11, 1998

[51] Int. Cl.[7] ..... E06B 9/305

[52] U.S. Cl. ..... 160/168.1 R; 160/176.1 R; 160/902

[58] Field of Search ..... 160/168.1 R, 176.1 R, 160/173 R, 177 R, 178.3 R, 902; 248/262

[56] References Cited

U.S. PATENT DOCUMENTS

| | | | |
|---|---|---|---|
| 1,878,186 | 9/1932 | Rudolph . | |
| 2,390,826 | 12/1945 | Cohn | 160/176.1 R |
| 3,327,765 | 6/1967 | Strahm et al. | 160/168.1 R |
| 4,623,012 | 11/1986 | Rude et al. . | |
| 4,697,630 | 10/1987 | Rude . | |
| 4,699,196 | 10/1987 | Elliott | 160/168.1 R |
| 5,184,660 | 2/1993 | Jelic . | |
| 5,228,491 | 7/1993 | Rude et al. . | |
| 5,232,037 | 8/1993 | Fraser . | |
| 5,293,921 | 3/1994 | Marocco . | |
| 5,297,608 | 3/1994 | Rap et al. . | |
| 5,645,685 | 7/1997 | Furhman . | |
| 5,662,154 | 9/1997 | Drake, III . | |

FOREIGN PATENT DOCUMENTS

| | | | |
|---|---|---|---|
| 1075601 | 10/1954 | France | 160/168.1 |
| 6616583 | 5/1968 | Netherlands | 160/168.1 |

*Primary Examiner*—Blair M. Johnson

*Attorney, Agent, or Firm*—Knobbe, Martens, Olson & Bear, LLP

[57] ABSTRACT

A window blind having a plurality of substantially identical mounting blocks that are adapted to receive a mounting rod in an aperture formed in each of the mounting blocks wherein the mounting rod is comprised of a plurality of mounting rod sections that can be connected together by sleeves so as to form a mounting rod of a variety of lengths. At one end of the mounting rod, a tilt actuator block is attached. The tilt actuator block has a gearing mechanism such that user manipulation of a pair of cords will result in rotation of the mounting rod. The plurality of slats are attached to the mounting section. The mounting blocks further include a guide plate that receives the lift cord wherein the guide plate has an aperture that allows the lift cord to be extended vertically downward from the mounting section to be connected to the horizontal slats. As each of the components of the mounting section 102 are substantially identical, the component can be used to manufacture mounting sections incorporating both tilting mechanisms and lifting mechanisms for window blinds of a variety of lengths.

32 Claims, 8 Drawing Sheets

200
136
120
222
216
212
214
210
200
202
212
204
146a
146b
116
126
122
124
230
226
232
164
140
156
170
104
224
174
176

MODULAR HORIZONTAL WINDOW BLIND

BACKGROUND OF THE INVENTION

1. Field of the Invention

The present invention relates to horizontal window blinds and, more particularly, concerns horizontal window blind designs having modular components which can be used to manufacture window blinds of varying sizes in an efficient manner.

2. Description of the Related Art

Horizontal window blinds are commonly used window coverings. Typically, the horizonal window blinds consist of a head rail member, that contains both a tilting mechanism and a lifting mechanism, and a plurality of horizontal slats that are connected to the head rail and are arranged in parallel so as to be able to be positioned in front of the window when the head rail member is mounted to the window frame. The slats are generally mounted on string ladders which are attached to the tilting and lifting mechanisms contained within the head rail. The string ladders are essentially comprised of two vertical string members having a connecting piece extending therebetween. The slats are generally positioned on or captured by the string ladders so that the outer edges of the slats are positioned inside of the vertical strings with the slats resting on or between the horizontal connecting pieces of the string ladders.

The lifting mechanism is generally comprised of at least two lifting strings that are adapted to be threaded through openings formed at the outer ends of each of the slats and are then anchored in a bottom rail. The lifting strings are attached to a pulley and catch mechanism or a roller and lock mechanism such that the operator, by pulling on a drawstring, can either raise or lower the slats. The tilting mechanism is generally comprised of a relatively small dimensioned rotatable member that is positioned within the head rail so as to extend across the width of the window. Typically, a rod is attached to a gear mechanism such that user rotation of the tilt rod induces the rotatable member to rotate within the head rail. The outer support strings of the ladders are attached to the rotatable member such that rotation of the rotatable member results in vertical displacement of one outer support string relative to the other thereby causing the slats interposed therebetween to rotate or tilt.

Hence, a user can vary the amount of light entering a room by manipulating the tilting mechanism so as to adjust the slats in the rotational or tilted position. The position of the slats typically can continuously vary between a first position, where the plane of the slats is essentially perpendicular to the plane of the window thereby allowing light to enter through the blinds, and a second position, where the plane of the slats is essentially parallel to the plane of the window thereby preventing light from entering through the blinds.

While horizontal window blinds of the type described above are commonly used, there are several difficulties associated with these window blinds. Initially, many of the components used in prior art window blinds are expensive to manufacture and are relatively easily damaged. For example, the head rail is typically made out of relatively thin metal, such as aluminum or steel, that can be easily damaged during assembly, shipping, or installation. Damaged head rails will often interfere with the correct operation of the tilting mechanism or the lifting mechanism thereby preventing the blind from operating correctly.

In particular, the headrail itself must be cut to the desired length. The cutting process, however, often results in the walls of the headrail becoming bent. As components have to be positioned within the headrail, bent or deformed headrail walls often can prevent correct installation of the components within the headrail. Moreover, to even form the headrails, expensive equipment must often be used. For example, the headrail must not only be cut to size but also pressed into the desired shape. Hence, a window blind manufacturer must purchase both presses and shears to form the headrail member and the act of forming the headrail often results in damage to the headrail that complicates the assembly of the window blind.

Moreover, the assembly of most commonly available prior art window blinds is very time consuming and labor intensive which results in relatively high assembly costs. For example, in many prior art window blinds, intricate gear mechanisms typically interconnect the user actuating tilt rod to the rotatable member positioned within the head rail. This intricate gear mechanism can require a considerable amount of effort to install this intricate mechanism within the head rail. In general, the components that are to be mounted within the headrail generally have to be positioned within a confined opening defined by the headrail itself. As the headrails are only several inches in cross-section and depth, there is not a lot of room for an assembler to handle and interconnect the components within the headrail. Hence, the assembly and positioning of the components in the headrail can be a very time consuming task for the assembler due to the limited amount of space within the headrail.

A further difficulty that adds to the expense of manufacturing prior art window blinds is that different sizes of blinds often require different size components. This often requires the manufacturer to stockpile large, unwieldy, difficult to store raw components. For example, large pieces of the materials used to form the headrails must be stored so that these pieces can be subsequently cut and shaped to form headrails adapted to fit different sizes of windows. As the material is thin and the raw pieces are typical quite long, the material often gets damaged in storage which results in both significant wastage of material and time consuming efforts to reshape the material for subsequent use.

A further difficulty stems from the fact that window blinds are preassembled in a factory in standard or custom sizes and then shipped to the job site in an assembled format. However, the headrails can also be easily damaged during shipment due to the thinness of the materials used to form the headrail. Once the headrail is damaged, it may no longer be possible to mount the headrail in a window frame or the damage to the headrail may impair the correct operation of the lifting and tilting mechanisms contained within the headrail. As a consequence, damaged headrails are typically returned to the manufacture r for repair adding to the manufacturers costs. An additional difficulty relating to shipping is that the assembled headrails of the prior art are typically made out of metal materials and are quite heavy. As such, the overall shipping costs of the window blinds of the prior art can be quite expensive.

Yet another difficulty of window blinds of the prior art is that the headrails must be almost exactly the right size to be correctly mounted within the window. Typically, the headrail is mounted at either end to the window frame. If the headrail is too long, it will not fit within the window. Further, if the headrail is too short, the mounting brackets that are mounted to the sides of the window frame will generally not engage the headrail and will not securely hold the window blind to the window frame. A significant source of damage to prior art window blinds occurs when installers attempt to fit a mis-measured headrail into a window frame.

Moreover, often times the standard sized prior art window blinds are not well adapted for use with larger windows. In these circumstances, the installer must use multiple blinds to cover a single large window. This results in a window blind assembly that can have an undesirable appearance. This problem is further exacerbated by the typical construction of the window blinds which makes it difficult to produce window blinds having a width of greater than generally four feet. Hence, for larger windows, multiple blinds must be installed. However, multiple blinds often have an undesirable appearance and also require the manipulation of multiple sets of controls to adjust the blinds.

Yet another problem with window blinds of the prior art is that the headrail is often covered by a decorative valence. The decorative valence can be made of a nicer appearing material that the plain metal of the typical headrail. However, the attachment of the valence to the headrail is often unsatisfactory. Either a simple hook and loop fastener is used to secure the valence to the headrail or a more complicated catch mechanism is used. The problem with the simple hook and loop fastener is that, over time, the fastener becomes ineffective resulting in the valence not being securely fastened to the headrail. Moreover, the more complicated catch mechanisms add to the expense of the window blind and often have an undesirable appearance.

Hence, from the foregoing, it will be appreciated that there is a need for a window blind assembly which is simplified in design, less prone to damage, easier to install and is more readily adaptable to cover windows of different sizes. To this end, there is a need for a window blind assembly which has modular components that can be flexibly mounted together to result in the assembly of window blinds of a variety of sizes in a simple and inexpensive manner.

SUMMARY OF THE INVENTION

The aforementioned needs are satisfied by the window blind apparatus of the present invention which is comprised of a plurality of mounting blocks having apertures formed therein and at least one rotatable member that is positioned within the apertures in each of the mounting blocks. The window blind apparatus also includes a plurality of ladder assemblies having two outside members with a plurality of brace members extending between the outside members. A plurality of slats can be positioned on or between the outside members on the support members so as to be arranged in a parallel fashion width-wise across a window and the ladder assemblies are adapted to be connected to points along the rotatable member. The apparatus also includes a tilting mechanism that is coupled to the rotatable member so that manipulation of the tilting mechanism results in rotation of the rotatable member which further results in movement of the outer members of the ladder assembly with respect to each other to thereby tilt the slats. In one embodiment, the tilting mechanism is adapted to be attached to an end of the rotatable member via a tilt actuator block similar to the mounting block.

The window blind apparatus of the present invention is more flexible in its installation as it uses a plurality of mounting blocks that are adapted to be connected to the window frame. In one aspect, the window blind apparatus includes at least one plate adapted to be mounted to a window frame and the blocks are adapted to slidably engage with the plate to mount the assembly to a window frame. In one embodiment, the mounting blocks are comprised of blocks having an aperture formed therein with a mounting wedge formed on a first surface of the mounting blocks. The window blind apparatus also includes a plurality of plates having grooves formed therein. The plurality of plates are adapted to be mounted to the window frame and the plurality of mounting wedges on the mounting blocks are adapted to engage with the grooves in the plates to secure the mounting blocks to the window frame.

In one embodiment, the grooves and wedges are adapted to extend in a direction that is substantially perpendicular to the plane of the window. It will be appreciated that having the grooves and wedges formed in this fashion simplifies the installation of the window blind to a window. In another embodiment, the plates having the grooves are adapted to be mounted to a surface that is parallel to the plane of the windows. The mounting blocks are adapted to have wedges that can be mounted within the grooves on the plate so that the mounting blocks can essentially be mounted to the outside of the window frame.

In one embodiment, a second surface of the mounting blocks are also adapted to have mounting wedges such that a cover member, such as a decorative valance, having matching grooves formed therein can be mounted to the mounting blocks. Since the valence is secured to the mounting blocks by the sliding engagement between the wedges and the grooves formed in the valence, the valence can be secured to the mounting blocks such that the effects of sunlight in warping the valence will not result in the valence detaching from the mounting blocks.

In another aspect of the invention, the rotatable member is comprised of a plurality of sections that are interconnected together using connectors. It will be appreciated that the use of mounting blocks and a rotatable member, comprised of a plurality of sections that can be connected together, allows the same components to be used to form different window blinds of different lengths. In particular, the rotatable rod sections can be connected to form a rotatable rod that extends substantially across a particular window. The mounting blocks can be added, as needed, to ensure that the rotatable rod and plurality of slats are adequately supported when mounted to the window frame. Additional mounting blocks can be added to provide additional support for window blinds that use heavier material for the slats.

In another aspect, the tilting actuator mechanism is contained within a tilt actuator block that is adapted to be positioned on the end of the rotating member. In one embodiment, the user can actuate the tilting actuator mechanism by pulling on cords attached to the mechanism. The tilting actuator mechanism can be used with rotatable member of varying size as it is adapted to be positioned on one end of the rotatable member.

In another aspect of the invention, the mounting points for the outer members of the vertical blind assemblies are comprised of the connecting sleeves that are positioned about the rotatable member. The use of sleeves to form the mounting locations for the rotating member allows the exact location of the mounting locations for the outer members of the ladder assemblies to be varied during assembly of the window blind apparatus. In one embodiment, the outer members of the ladder assemblies are comprised of strings that have larger diameter securing members attached to the ends of the strings and the mounting locations on the sleeves are comprised of holes which are adapted to receive the securing members at the ends of the outer members of the ladder assemblies so that attachment of the ladder assembly to the tubular member is comprised of positioning the securing members within the openings adapted to receive the securing members.

From the foregoing, it will be appreciated that the window blind apparatus of the present invention is simple to assemble and install in a window. The apparatus is comprised of a plurality of modular components such that window blinds of varying sizes can be made using essentially the same set of components. The simplified assembly of the window blind apparatus of the present invention results in lower assembly costs. Moreover, the use of mounting blocks and a single rotating member which, in one embodiment, is formed from a plastic material, results in a window blind that is lighter, capable of supporting heavier blinds and is less likely to be damaged during shipment and is able to support greater weight. These and other objects and advantages of the present invention will become more fully apparent from the following description taken in conjunction with the accompanying drawings.

DETAILED DESCRIPTION OF THE PRESENT INVENTION

Figure 1:
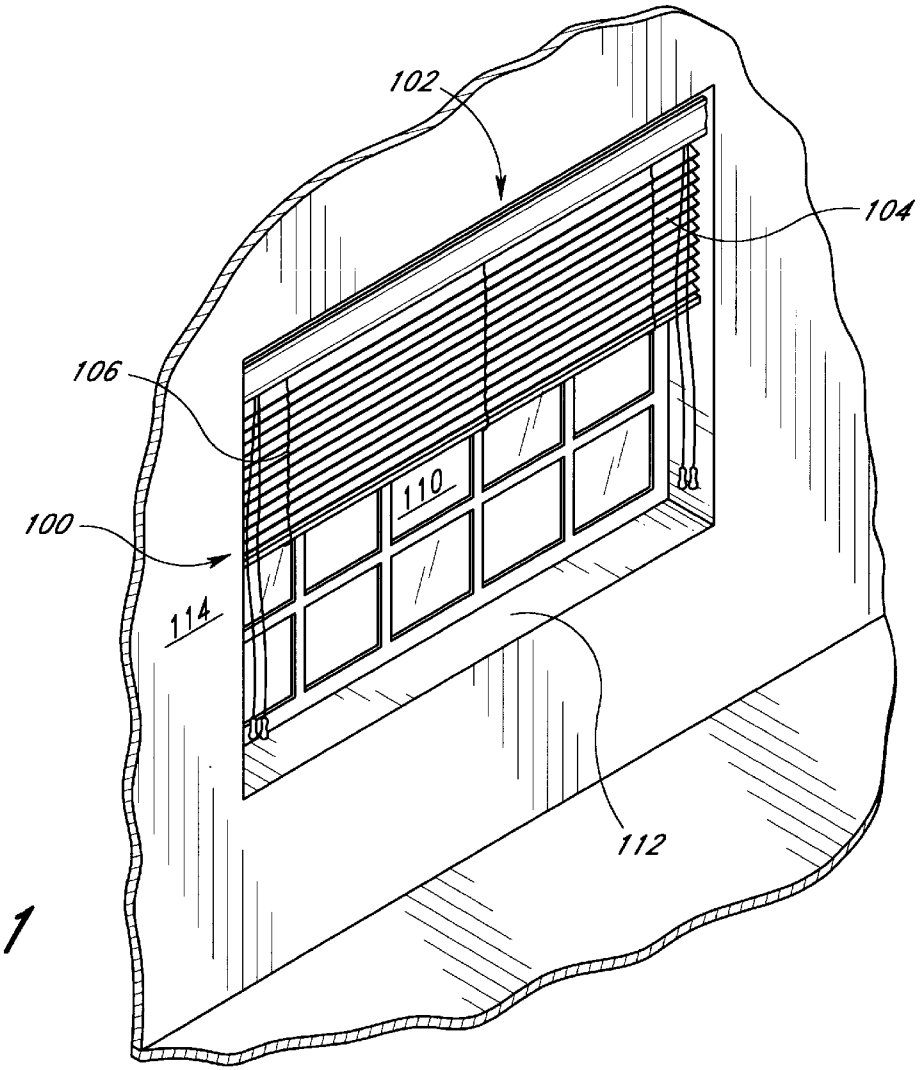
FIG. 1 is an isometric view of one embodiment of a window blind apparatus mounted in a window formed in a wall.

Reference will now be made to the drawings wherein like numerals refer to like parts throughout. FIG. 1 is a perspective view of one embodiment of a window blind apparatus 100 of the present invention as it is mounted to a window frame 112 so as to cover a window 110 formed in a wall 114. As illustrated in FIG. 1, the window blind apparatus 100 includes a mounting section 102 that is mounted to the window frame 112 in a manner that will be described in greater detail below in reference to FIGS. 2A and 2B. The mounting section 102 also includes various lifting and tilt mechanisms adapted to lift and tilt a plurality of horizontal slats 104 captured within ladder assemblies 106 that are connected to the mounting section 102 in a manner that will be described in greater detail below.

Basically, the window blind 100 is comprised of the mounting section 102 that is adapted to secure the window blind 100 in a position to cover the window 110. The mounting section 102 also contains the mechanisms that will allow a user to raise and lower the plurality of slats 104 to a desired vertical position in front of the window and then also cause the horizontal slats 104 to tilt to vary the amount of light being let in through the window 110 and the window blind apparatus 100. The plurality of horizontal slats 104 can be comprised of slats made of a number of materials including aluminum, wood, plastic and the like. Moreover, as will become more fully apparent from the following description, the dimensions of the window blind can be varied during the assembly of the window blind 100 to cover windows of a plurality of different sizes. Hence, the configuration of the window 110 in FIG. 1 should only be taken as an example of one particular application of this embodiment of the window blind apparatus 100.

Figure 2A:
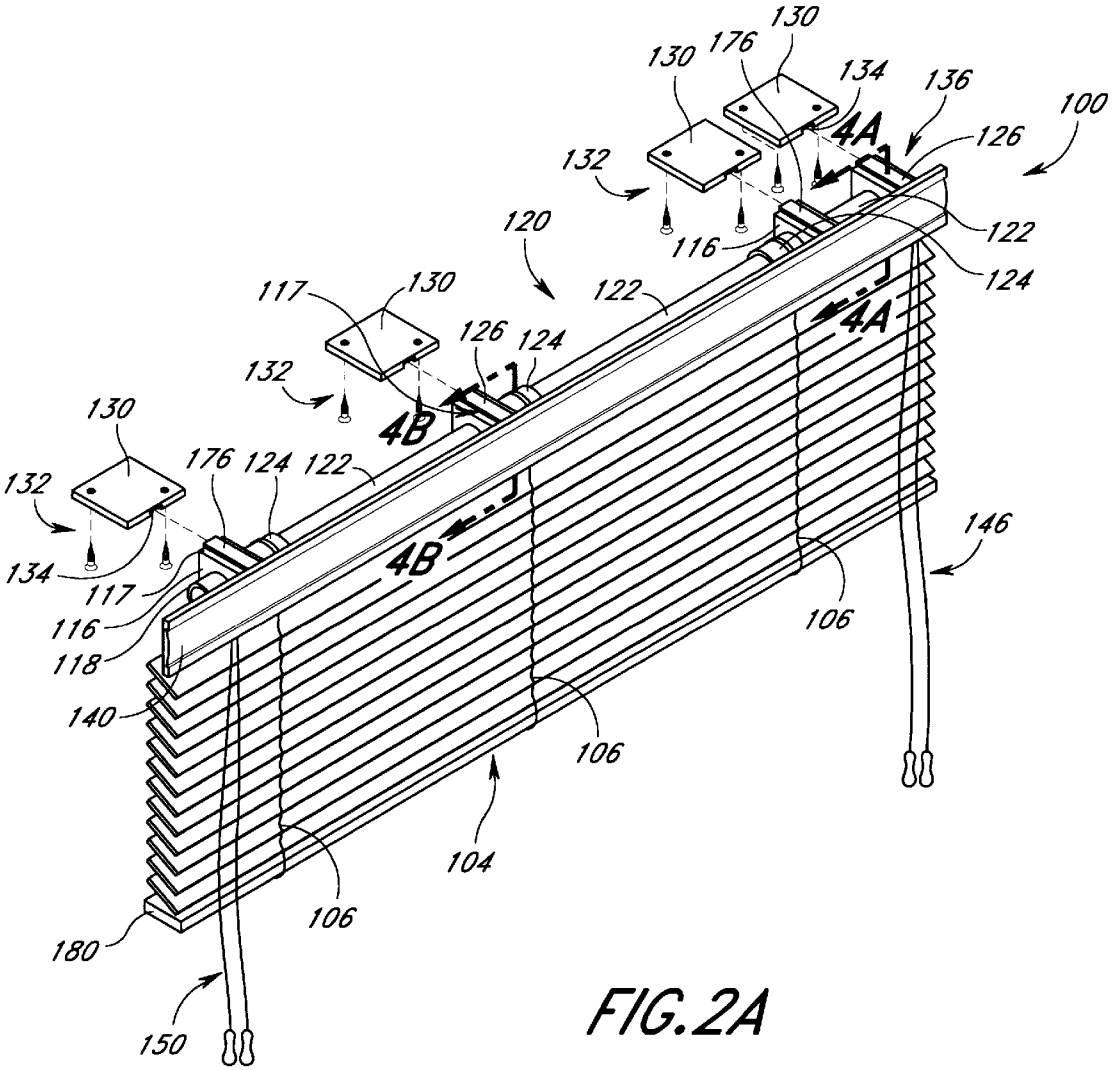
FIGS. 2A and 2B are isometric views of the window blind of FIG. 1 illustrating the manner in which the window blind assembly of FIG. 1 is mounted to the window frame.
Figure 2B:
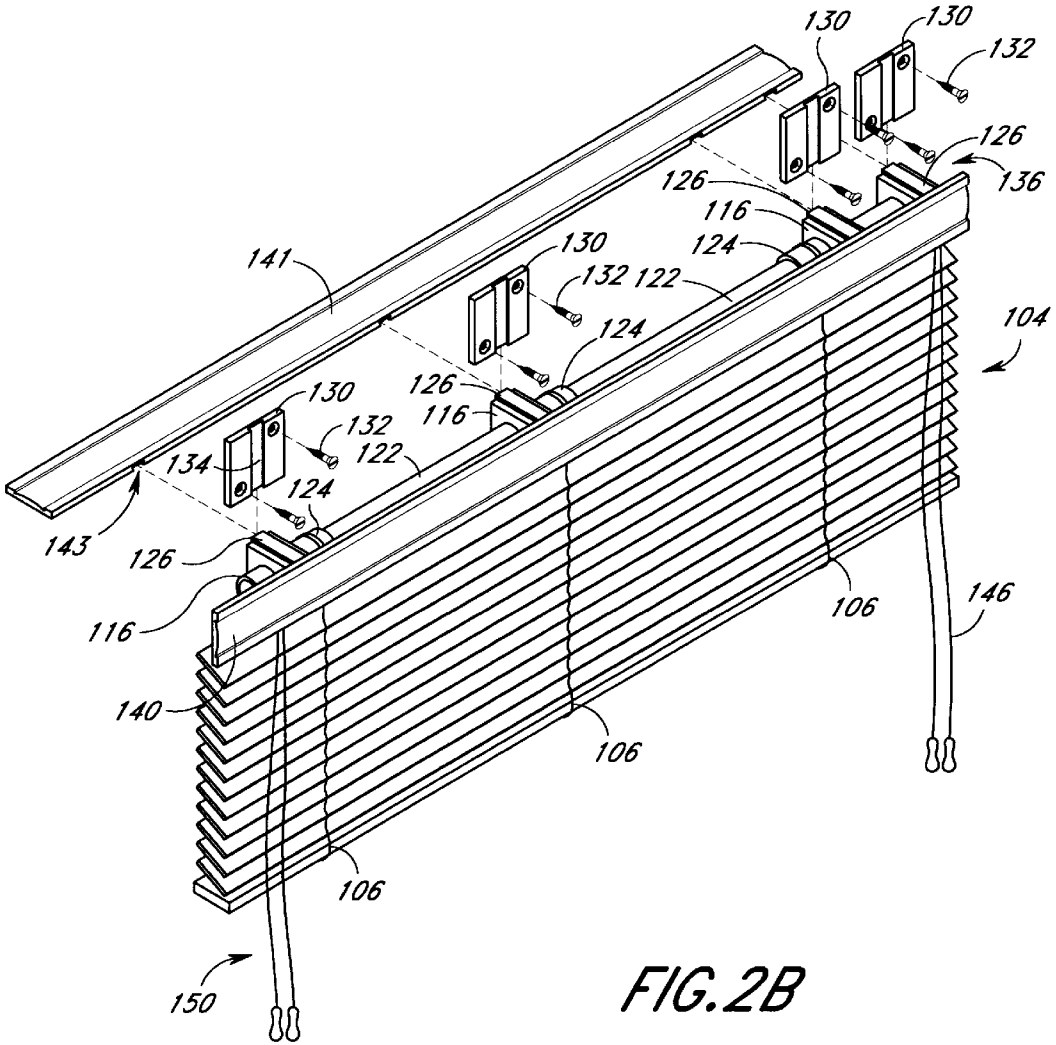

FIGS. 2A and 2B are perspective views which illustrate the components of the mounting section 102 that are adapted to allow for easy installation of the window blind 100 to the window frame 112. In particular, the mounting section 102 includes a plurality of mounting blocks 116 having apertures 118 formed therein. A rotatable mounting rod 120, comprised of a plurality of rod sections 122 interconnected by rod sleeves 124 are positioned so that rod sections 122 are positioned within the apertures 118. Preferably, the sleeves 124 can be adapted to securely retain the rod sections 122 therein, either by friction fit, the use of epoxy or a catch member (not shown) formed in the sleeve 124. As will be discussed in greater detail below, the apertures 118 are sized so as to allow rotational movement of the mounting rod 120 within the apertures 118.

The plurality of mounting blocks 116 in this embodiment can be formed out of plastic using injection molding techniques. As shown in FIGS. 2A and 2B, the mounting blocks 116 are substantially identical and are generally square in shape having the circular aperture 118 formed therein. At least one of the outer surfaces 117 of the mounting blocks 116 has a mounting wedge 126 formed thereon. The mounting wedge 126 extends outward from the outer surface 117 of the mounting block 116.

The mounting wedges 126 on the mounting blocks 116 are adapted to be positioned within grooves 134 formed on a plurality of mounting plates 130. Specifically, the mounting plates 130 are comprised of flat plates that are adapted to be secured to the window frame 112 through the use of screws 132. Each of the mounting plates defines a groove 134 that is adapted to receive the mounting wedge 126 formed on the outer surface 117 of the mounting block 116.

Figure 2C:
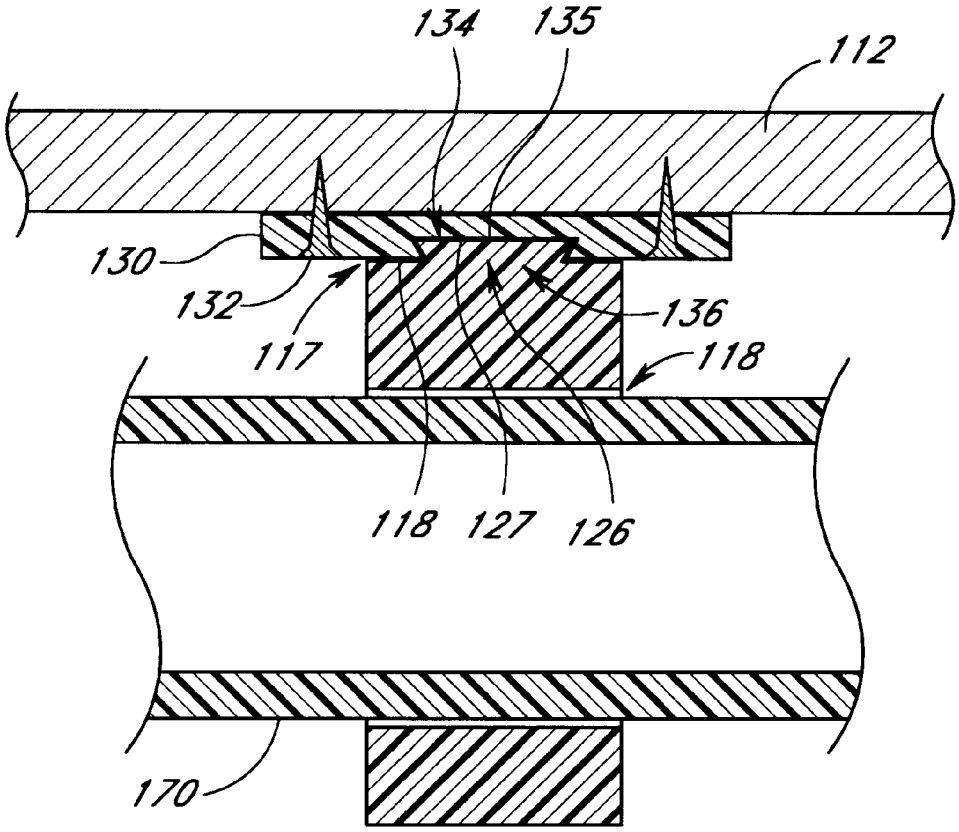
FIG. 2C is an elevational view of a detail of the window blind of FIG. 2A, further illustrating the mounting of the window blind to the window frame.

Referring to FIG. 2C, the mounting wedge 126 is tapered inward so that an outer surface 127 of the wedge 126 has a greater cross-sectional width than the cross-sectional width of the wedge 126 at the interface between the wedge 126 and the outer surface 117 of the mounting block 116. Similarly, the groove 134 is also adapted so that the width of the groove 134 at an inner surface 135 is greater than the width of the groove at the outer aperture 136 of the groove 134. The wedge 126 of the mounting block 116 is therefore mounted in the groove 134 of the mounting plates 130 by sliding the wedge 126 in a direction that is parallel to the axis of the groove 134. The tapering of both the wedge 126 and the groove 134 inhibit the mounting block 116 from being pulled away from the mounting plate 130 in a direction that is perpendicular to the plane of the groove 134.

As is also illustrated in FIG. 2C, the mounting plate 130 can be attached to the window frame 112 using the screws 132. Hence, the mounting blocks 116 are easily mounted to the window frame 112 by initially mounting the mounting plates 130 to the window frame 112 and then positioning the mounting wedges 126 of the mounting blocks 116 in the grooves 134 of the mounting plates so that the mounting block 116 is secured to the window frame 112. Typically, the rotatable rod 120 is captured in the apertures 118 of the mounting blocks 116 and the plurality of slats 104 are connected to the mounting section 102 prior to slidably engaging the wedges 126 into the grooves 134. The installer then simply has to correctly mount the mounting plates 130 to the window frame 112 and then simultaneously position the wedges 126 adjacent the openings to the grooves 134 and then slide the wedges 126 into the grooves 134 in a direction perpendicular to the plane of the window 110 to mount the window blind apparatus 100 to the window frame 112. Hence, the window blind 100 can be mounted in a position adjacent the window 110 by mounting the plates 130 to the window frame 112 and then slidably engaging the mounting blocks 116 with the plates 130.

In one embodiment, the mounting plate 130 will be positioned on the upper surface of the window frame 112. However, it will be appreciated that in some circumstances it may be desirable to mount the window blind assembly 100 directly to a wall adjacent the window 110. In this circumstance, the window blind assembly 100 and, in particularly, the mounting blocks 116 can be adapted to have the mounting wedges 126 formed on two outer surfaces 117 of the mounting block 116 in the manner shown in FIGS. 4B and 4C. The mounting blocks 116 can then be connected to the mounting plates 130 when the mounting plates 130 are attached to a wall so that the plane of the mounting plates 130 are parallel to the plane of the window 110. This alternative mounting configuration is illustrated in greater detail in FIG. 2B. As shown in FIG. 2B, the mounting plates 130 are mounted so as to be parallel to the plane of the window. The mounting blocks have wedges 126 that can be positioned in the grooves 134 by sliding the wedges 126 vertically with respect to the grooves 134. Preferably, the wedges 126 on the mounting blocks 116 are slid from the upper end of the grooves 134 downward to ensure that the wedges 126 are frictionally retained within the grooves 134 to retain the wedges 126 in the grooves 134 against the weight of the window blind assembly 100. In some circumstances, it may be desirable to taper the grooves so that the wedges 126 cannot slide through the length of the grooves 134 thereby detaching the mounting blocks 116 from the mounting plates 130.

As is also shown in FIGS. 2A and 2B, the window blind assembly 100 also includes a tilt actuator block 136 that has the same basic configuration as the mounting blocks 116 and, in this embodiment, includes the mounting wedge 126 and an aperture 222 that is adapted to receive the rod 120. However, as will be described in greater detail herein below, the tilt actuator block 136 also includes a tilt actuator mechanism (not shown) which allows the user to rotate the horizontal slats 104 captured within the ladder assemblies 106, by manipulating the tilt cords 146. The tilt actuator block 136 is attached to an end of the mounting rod 120. As is also shown in FIG. 2A, the tilt actuator block 136 is also adapted to mount to a mounting plate 130 attached to the window frame 112 to provide additional support for the window blind apparatus 100.

As will be more apparent from the following description, the length of the mounting rod 120 can be varied by using different numbers and sizes of rod sections 122 interconnected by the sleeves 124. Having a discrete tilt actuator block 136 that is adapted to attach to an end of the mounting rod 120, allows the tilt actuator block 136 and the tilt mechanism contained therein to be used with horizontal blind assemblies 100 of a plurality of different lengths. Hence, the assembly of window blinds 100 is simplified and made less expensive as substantially identical or interchangeable components, such as the mounting blocks 116 and the tilt actuator block 136, can be used to manufacture window blinds 100 of a plurality of different sizes.

FIGS. 2A and 2B illustrate that a decorative cover member 140, such as a valance, is also attached to the mounting blocks 116 and tilt actuator block 136 so as to cover the mounting blocks 116, tilt actuator block 136 and the mounting rod 120 from view. The attachment of the cover member 140 to the mounting blocks 116 will be described in greater detail in reference to FIG. 3 below. Moreover, as shown in FIG. 2B, when the window blind assembly 100 is attached directly to the wall, it may also be desirable to attach a second decorative cover member 141 so as to cover the top surface of the mounting blocks 116 and the mounting rod 120. In this embodiment, the second decorative plate 141 has a plurality of grooves 143 formed therein that are adapted to engage with the mounting wedges 126 on the mounting block 116 so as to cover the mounting blocks 116 and the mounting rod 120 from two different viewing angles.

Figure 3A:
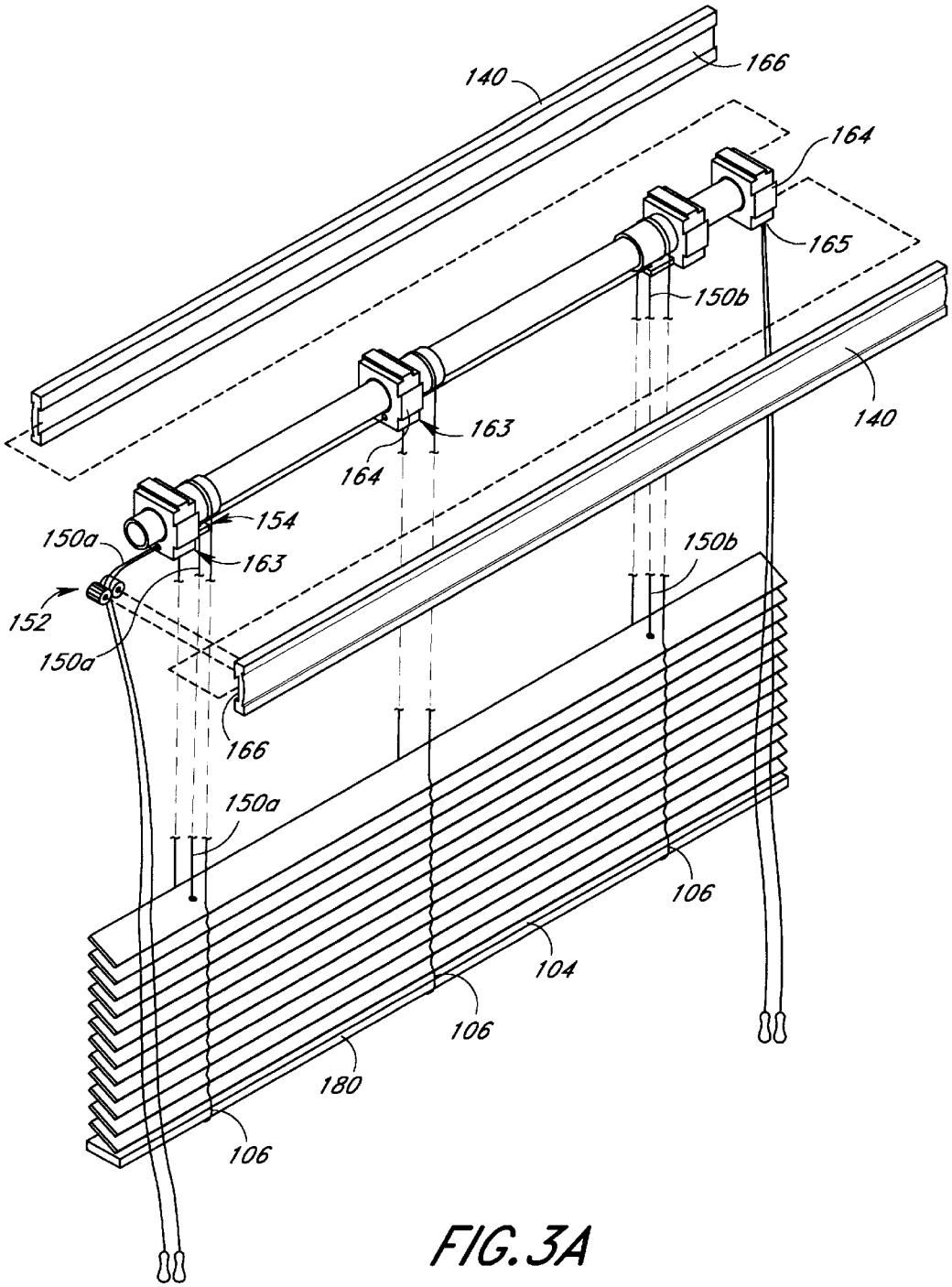
FIG. 3A is an isometric view of the window blind of FIG. 1 illustrating the attachment of an optional decorative members to the window blind assembly.

Referring now to FIG. 3A, the decorative cover member 140 has a groove 166 which preferably extends the full length of the decorative cover member 140. The mounting blocks 116 and the tilt actuator block 136 preferably include wedges 164 formed on a front face 163 that are adapted to slidably engage with the groove 166 on the decorative member 140 so as to secure the decorative cover member 140 to the mounting blocks 116 and the tilt actuator block 136. In this embodiment, the wedges 164 extend across the width of the mounting blocks 116 and the tilt actuator block 136 so that the wedges 164 are transversely slid into the grooves 166 of the first decorative cover member 140 in the manner illustrated in FIG. 3A. The configuration of the outer surfaces of the decorative cover members 140 and 141 will, of course, vary depending upon the aesthetic appearance that is intended to by portrayed by the window blind 100. For example, the outer surfaces of these members can either be flush, channeled, grooved, or have artwork painted thereon.

As is also illustrated in FIG. 3A, the mounting blocks 116 can be adapted to have wedges 164 formed on a back surface so as to be able to receive the decorative member 140 on either side of the mounting block 116. It will be appreciated that when the window blind assembly 100 is mounted to the upper surface of a window frame, placing a decorative member 140 between the mounting blocks 116 and the rotatable member 120 hides the mounting blocks 116 and the rotatable member 120 from view. As the decorative members 140 are mounted to the mounting blocks 116 through the slidable engagement of the wedges 164 and the grooves 166 of the decorative member 140, the decorative members 140 are less likely to fall off as a result of deformation of the decorative member 140 due to exposure to sunlight. Moreover, since the decorative member 140 is secured at a plurality of different places along the length of the decorative member 140, any deformation due to exposure to sunlight is also reduced.

FIG. 3A also illustrates the mechanism by which the horizontal slats 104 are raised and lowered by the user of the window blind assembly 100. In particular, there are vertical adjustment cords 150*a*, 150*b* that are accessible to the user. The cords 150*a*, 150*b* are engaged with a catch mechanism 152, of a type known in the art, that in this embodiment is mounted to an inner surface of the first cover member 140. The catch mechanism 152 inhibits movement of the cords 150*a*, 150*b* unless the user has exerted a transverse force on the cords 150*a*, 150*b* to thereby release the catch mechanism 152 to enable the user to raise or lower the plurality of slats 104 by pulling or releasing the cords 150*a*, 150*b* in a manner that is well known in the art.

After engagement with the catch mechanism 152, the cords 150*a*, 150*b* are then threaded through a cord opening 156 in the mounting block 116 positioned adjacent the catch mechanism 152. As shown in FIG. 3A, each of the mounting blocks 116 include a cord opening 156 that is adapted to receive one or both of the cords 150*a*, 150*b*. Preferably, the vertical adjustment cords 150*a*, 150*b* are adapted to engage with the slats 104 towards the outer end of the slats. The mounting blocks 116 include guides 154 that receive the cords 150*a*, 150*b* from the opening 156 and guide the cords 150*a*, 150*b* towards the attachment points of the slats 104.

Figure 5:
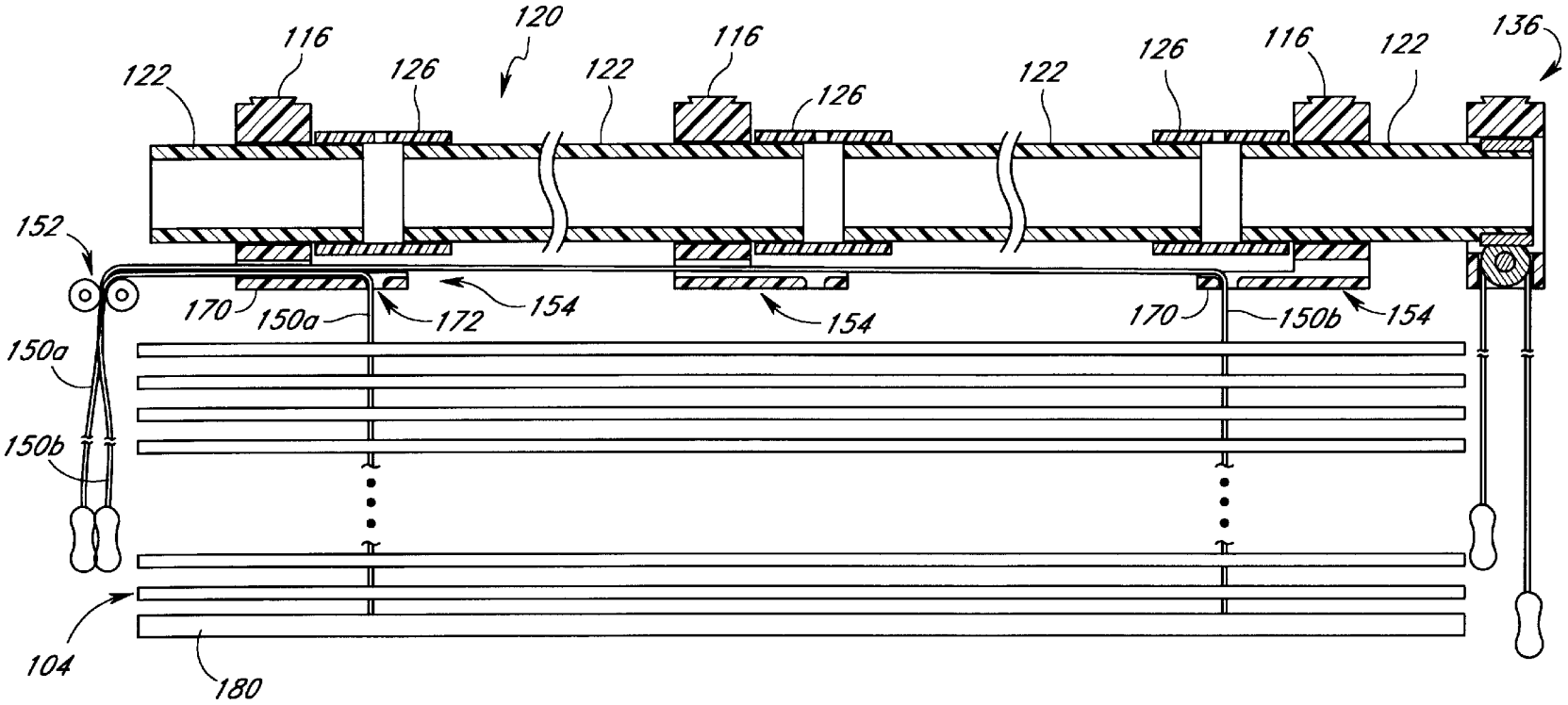
FIG. 5 is a cross-sectional view of FIG. 3A of the window blind of FIG. 1 illustrating the modular attachment of the components of the window blind assembly of FIG. 1.

The configuration of the guides 154 on the mounting blocks 116 is shown in greater detail in FIG. 5. In particular, the guides 154 are comprised of a horizontal plate 170 that extends transversely outward from the mounting block 116 in a direction parallel to the mounting rod 120. The guide plate 170 has an aperture 172 through which the cords 150*a*, 150*b* can be positioned. In particular, the cords 150*a*, 150*b* are then directed through the apertures 172 in the guides 154 and are then directed into openings 160 in each of the slats 104. As shown in FIG. 3, the cords 150*a*, 150*b* are positioned through openings 160 that are formed towards the ends of the slats 104 at a position that is approximately one-half of the way across the width of the slats 104. In this embodiment, the cords 150*a*, 150*b* are positioned so as to be interposed between two outer ladder strings 174, 176 of the ladder assemblies 106*a*, 106*b*. The vertical adjustment cords 150*a*, 150*b* are then connected to a bottom rail 180 so that when the user pulls on the cords 150*a*, 150*b* the bottom-most slat 180 and all of the intervening slats 104 are raised or lowered in a manner known in the art. As will be described in greater detail below, the outer ladder strings 174, 176 are mounted to the connectors 126 of the rotatable rod 120. In this embodiment, a connector 120 is positioned adjacent the mounting blocks 116 that the cords 150*a* or 150*b* are positioned so as to extend through the apertures 172 in the guide plate 170 to connect to the slats 104. In this way, the lift cords 150*a*, 150*b* and the ladder assemblies 106 can be vertically aligned.

As shown in FIG. 5, the guides 154 are an integral component of each of the mounting blocks 116. Making the guides 154 an integral component of the mounting blocks 116 means that during the manufacture of the window blind assembly 100, that the same mounting block 116 can be used interchangeably with any other mounting block by simply reversing the orientation of the mounting blocks 116. Preferably, the mounting blocks 116 are manufactured through the use of injection molded plastic so that a single mold can be used to make all of the blocks 116.

Figure 3B:
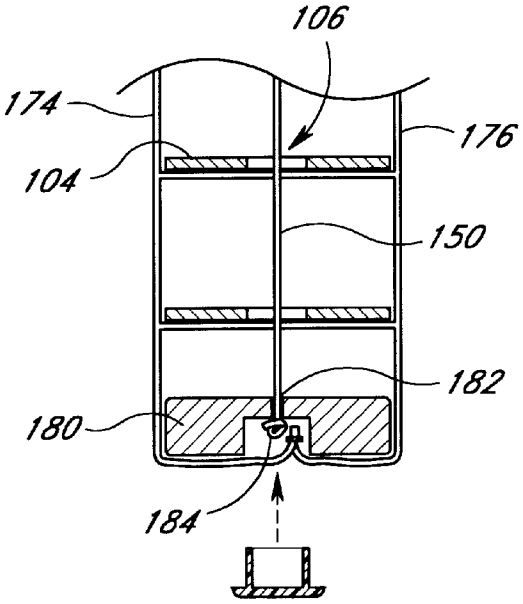
FIG. 3B is an isometric view of a detail of the window blind of FIG. 3A further illustrating how the horizontal slats are secured in the window blind.

FIG. 3B illustrates the connection of the cords 150*a*, 150*b* to the bottom rail 180. In particular, the bottom rail 180 has a hole 182 extending therethrough which has a capture recess 184 that is mounted adjacent the hole 182. The end of the cord 150*a*, 150*b* is knotted and is adapted to prevent the cord 150 from exiting the recess 184 through the hole 182 during lifting of the cord 150*a*, 150*b*. A cap 186 is adapted to be positioned within the recess 184. In this embodiment, the ends of the outer ladder strings 174, 176 are also positioned within the recess 184 so that the cap 186 can be positioned within the recess 184 to retain both the outer ladder strings 174, 176 and the vertical adjustment cords 150*a*, 150*b* in the recess 184.

Hence, the cords 150 are secured to the bottom rail 180 so that the user can raise and lower the bottom rail by pulling or releasing the free ends of the cords 150*a*, 150*b* respectively. The raising of the bottom rail 150*a*, 150*b* through the manipulation of the lift lower cords 150*a*, 150*b* results in the intervening plurality of slats 104 being raised and lowered in a manner that is similar to the operation of prior art horizontal blinds. It will be appreciated that the assembly of the vertical adjustment mechanism of this embodiment of the window blind apparatus 100 is simplified in that the assembler simply has to thread the cords 150*a*, 150*b* through the openings 156 in the mounting blocks 116 and through the apertures 172 and the guide plates 170 attached to the mounting blocks 116 at the desired locations, then thread the lift lower cords 150*a*, 150*b* through each of the openings 106 in each of the slats 104 until it is engaged with the recess 184 in the bottom rail 180. A skilled assembler should be able to accomplish this task in a very minimal amount of time thereby lowering this portion of the assembly cost of the window blind apparatus 100.

Figure 4D:
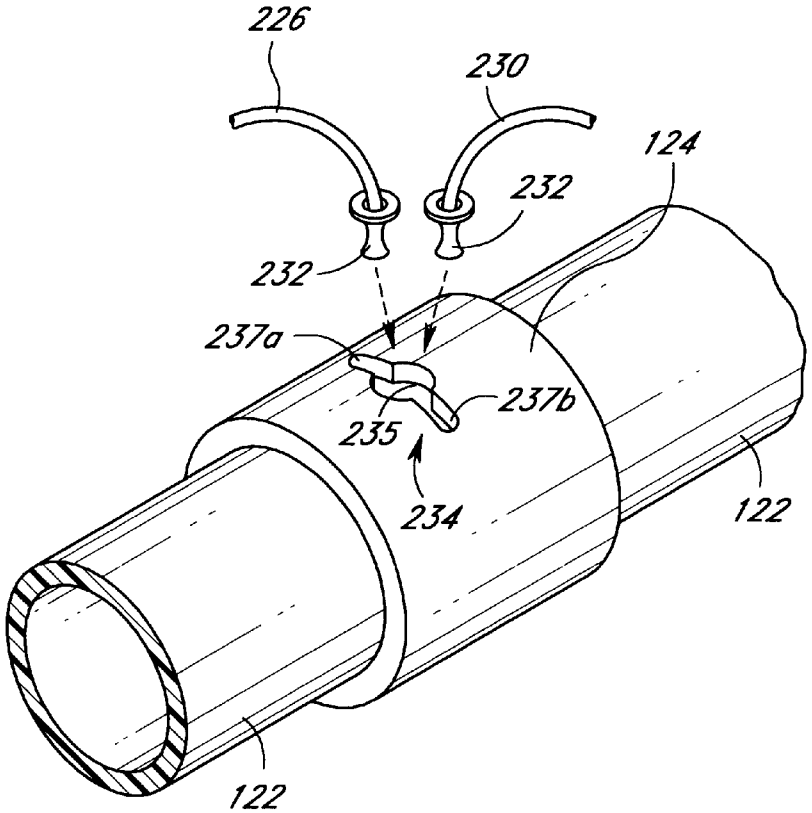
FIG. 4D is an isometric view of a detail of the window blind of FIG. 2A further illustrating the manner in which the horizontal slats are secured to the window blind apparatus.
Figures 4A, 4B, 4C:
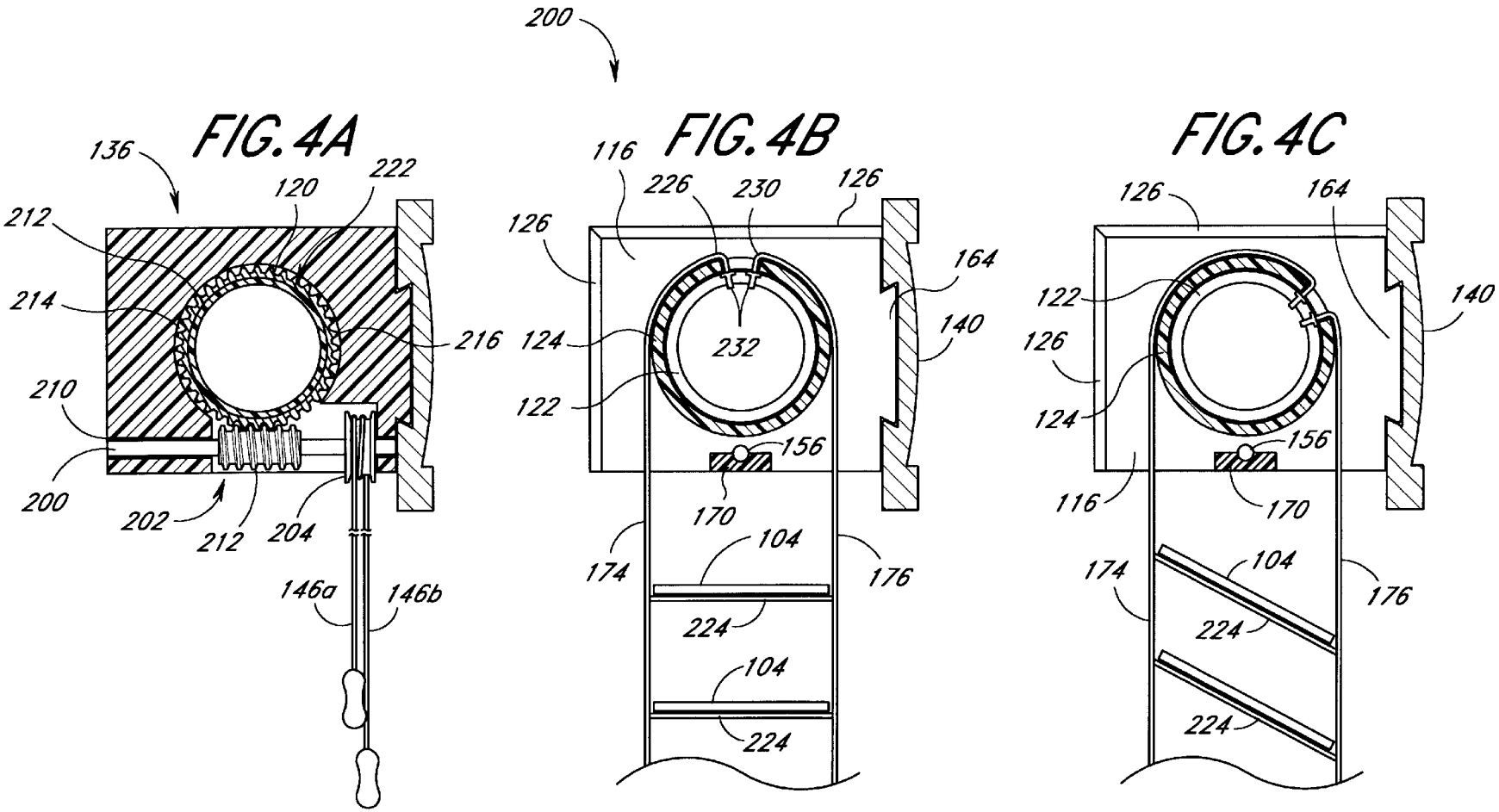
FIGS. 4A–4C are cross-sectional views, illustrating the components of a tilting mechanism of the window blind of FIG. 1.

FIGS. 4A–4D illustrate the components of a tilling mechanism 200 that is adapted to allow the user to tilt or rotate the slats 104 to vary the amount of light that will be transmitted through the window blind 100 when the window blind 100 is lowered so as to be positioned in front of the window 110. Referring initially to FIG. 4A, one embodiment of the tilt actuator 202 that is contained within the tilt actuator block 136 is shown. In particular, the tilt actuator block 136 includes a spool 204 that is fixedly attached to a shaft 206 which is rotatably mounted within an opening 210 formed in the interior of the tilt actuator block 136. The tilt cords 146 are wrapped about the spool so that vertical movement of the tilt cords 146 result in rotational movement of the spool 204 and the shaft 206. A worm gear 212 is fixedly mounted about the shaft 206 such that vertical movement of the tilt cords 146 result in rotational movement of the worm gear 212. As shown in FIG. 4A, there are, in fact, two tilt cords 146*a*, 146*b* which thereby allow the spool 204, the shaft 206 and the worm gear 212 to rotate in two rotational directions.

The tilt actuator block 136 also includes a circular opening 214 that receives a cylindrical gear 216 that is rotatably positioned within the opening 214 so as to be mechanically engaged with the worm gear 212 via an opening 220. The cylindrical gear 216 is engaged with the worm gear 212 such that rotation of the worm gear 212 results in corresponding rotation of the cylindrical gear 216. The cylindrical gear 216 includes an opening 222 that is adapted to receive the mounting rod 120. Preferably, the mounting rod 120 is frictionally engaged in the opening 222 of the radial gear 216 such that manipulation of the cords 146 causing rotation of the worm gear 212 corresponds to rotation of the mounting rod 120 in the manner shown in FIGS. 4B and 4C.

In particular, FIGS. 4B and 4C illustrate how the ladder assemblies 106 are attached to the mounting rod 120. As shown in FIG. 4B, each ladder assembly 106 is comprised of the two parallel ladder strings 174, 176 which extend vertically downward from the mounting rod 120. Brace strings 224 interconnect the vertical ladder strings 174, 176 at periodic intervals. The plurality of slats 104 are positioned on or between the brace strings 224 so as to rest on the brace strings 224 of at least two ladder assemblies 106. In the embodiment shown in FIG. 1, there are, in fact, three ladder assemblies 106. Positioning the lift lower cords 150*a*, 150*b* through the openings 160 in the slats 104 prevent the slats 104 from falling off of the brace strings 224 during raising and lowering of the slats 104. Preferably, the lifting and lowering cords 150*a*, 150*b* are alternatively woven between adjacent brace strings 224 so as to further reduce the likelihood of transverse movement of the slats 104 and dislodgement off of the brace strings 224.

A first end 226 of the ladder string 174 and a first end 230 of the ladder string 176 are each equipped with securing members 232. In this embodiment, the sleeves 124 that interconnect the rod sections 122 have an opening 234 that is adapted to receive the securing members 232. FIG. 4D illustrates the opening 234 in greater detail. In particular, the openings 234 formed in each of the sleeves 124 has a central portion 235 that is adapted to receive the securing members 232 on the ends 226, 230 of the outer ladder strings 174, 176. Two channels 237*a*, 237*b* are formed in the sleeves 124 extending outward from the central portion 235 of the opening 234. The securing members 232 are positioned within the channels 237*a*, 237*b* so that the securing members 232 are frictionally retained in the channels 237*a*, 237*b*. In this way, the outer ladder strings 174, 176 can be secured to the sleeves 124 which form a portion of the rotatable mounting rod 120. It will be appreciated that simply positioning the ends 226, 230 of the outer ladder strings 174, 176 into the channels 237*a*, 237*b* of the opening 234 greatly simplifies the task of connecting the ladder assemblies 106 top the mounting section 104 of the window blind apparatus 104.

Hence, the attachment of the securing members 232 into the opening 234 in the sleeve 122 results in the ladder assembly 106 being secured to the mounting rod 120. In this embodiment, the mounting rod 120 has a relatively large diameter, e.g., ¾" to 1", and the securing members 232 are secured to the openings 234 in the sleeve 124 at the top or "12 o'clock" position of the mounting rod 120 when the slats 104 are substantially perpendicular to the plane of the window 110 in the manner shown in FIG. 4B. Manipulation of the tilt cords 146*a*, 146*b*, however, result in rotation of the control rod 120 in the manner that was described previously in connection with FIG. 4A. As shown in FIG. 4C, rotation of the tilt rod in the clockwise direction results in the effective length of the ladder string 174 shortening while the effective length of the ladder string 176 lengthens which thereby cause the slats 104 to also rotate or tilt in a generally clockwise direction in the manner shown in FIG. 4C. Hence, the operator can adjust the tilt of the slats 104 by pulling on the tilt cords 146 which induce the mounting rod 120 to rotate within the openings 118 of the mounting blocks 116 as the mounting rod 120 is captured within the opening 218 of the cylindrical gear 216 of the tilt actuator 202. This rotation of the mounting rod 120 results in tilting of the slats 104. The tilting mechanism 200 may also include a catch mechanism which retains the slats 104 in a desired tilted orientation.

FIG. 5 further illustrates another desirable feature of this embodiment of the window blind apparatus 100. In particular, the components of the window blind apparatus 100 are all essentially modular which simplifies the assembly of the window blind apparatus 100. Moreover, as the components are all modular, the mounting section 102 of the window blind 100, which incorporates both the lifting mechanism 148 and the tilting mechanism 200, can be constructed for window blinds having a variety of different lengths using essentially the same components. In particular, the rotatable mounting rod 120 can be made from a plurality of mounting sections 122 that are interconnected with the mounting rod sleeves 124 until a mounting rod 120 of a desired length is achieved. The mounting blocks 116 can be periodically spaced along the mounting rod 120 so that adequate support is achieved for the weight of the window blind. Moreover, additional mounting blocks 116 can be added, as needed, anywhere along the mounting rod 120 to provide additional support for blinds incorporating heavier slats. The tilt actuator block 136 containing the tilting mechanism 200 can then be positioned on one end of the mounting rod 120. It will be appreciated that the tilt actuator block 136 containing the tilting mechanism 200 can be used with mounting rods having a variety of different lengths.

The lifting mechanism 148 can then be attached to the slats 104 by extending the lifting mechanism through the openings 156 in the mounting blocks 116 and then suspending the lift lower cords 154 through the apertures 172 in the guide plates 170 that are, in this embodiment, an integral portion of the mounting blocks 146. The lift cords 150 can then be attached to the bottom rail 180 in a simple manner. Further, the sleeves 126, which define the attachment location for the ladder assemblies 106 can also be positioned at any of a number of locations along the mounting rod 120 by selection of appropriately sized mounting rod sections 122. Hence, the attachment points of the ladder assemblies 106 to the mounting section 102 can also be easily adjusted to accommodate different sizes of blinds.

Hence, the assembly of the window blind assembly 100 in this embodiment is greatly simplified over the assembly of window blinds of the prior art. There are no intricate connections that are required to interconnect the plurality of slats 104 to either the tilting mechanism or the lifting mechanism. The lack of a headrail further simplifies the assembly process, as the assembler does not have to interconnect components in the confined space of the headrail. Moreover, the components comprising the mounting section 102 of the window blinds can be used to form mounting sections 102 for window blinds having a variety of different lengths. Further, since the materials comprising the components of the mounting section 102 are discrete components made of generally robust material such as plastics, the likelihood of damage to any of the components comprising the mounting section 102, the lifting mechanism 148, or the tilting mechanism 200 is greatly reduced when compared to window blinds of the prior art.

Furthermore, the mounting of the window blind assembly 100 is also simplified in that the mounting section 102 with the attached plurality of slats 104 can be mounted by positioning the wedges 126 on the plurality of mounting blocks 116 into corresponding grooves 134 formed in mounting plates 130 that are attached to either the window frame 112 or the wall 114 in the manner described above. As the grooves extend in a direction perpendicular to the plane of the window 110, the installer simply has to correctly orient the mounting wedges 126 on the mounting blocks 116 with respect to the grooves and then push the mounting section 102 into the plane of the window to securely mount the window blind 100 to the window frame 112. Alternatively, if the mounting plates 130 are attached to the outer surface of the wall 114 surrounding the window 116, the installer simply has to slide the mounting blocks in a generally downward motion so as to engage the wedges 126 in the grooves 134 of the mounting plates 130. Consequently, the window blind 100 of the preferred embodiments illustrates a window blind assembly that is simpler to manufacture and easier to install.

Although the preferred embodiment of the present invention has shown, described, and pointed out the fundamental novel features of the invention, it will be understood that various omissions, substitutions and changes in the form of the detail of the device illustrated may be made by those skilled in the art without departing from the spirit of the present invention. Consequently, the scope of the invention should not be limited to the foregoing description but is to be defined by the appended claims.

What is claimed is:

1. A window blind apparatus for covering a window of a building, the apparatus comprising:

a plurality of horizontal slats captured in at least one ladder assembly;

a plurality of mounting blocks each adapted to be separately mounted to a surface of the building adjacent the window, wherein the plurality of mounting blocks each define apertures that extend therethrough;

a rotatable rod having a first and a second end wherein the rotatable rod is positioned within the plurality of apertures so as to be rotatable within the apertures when the plurality of mounting blocks are mounted to the surface of the building adjacent the window so that the rod is maintained in a substantially horizontal position adjacent the window by the plurality of mounting blocks wherein the at least one ladder assembly is connected to the rotatable rod so that the plurality of slats are positioned in front of the window and so that rotation of the rod results in tilting of the plurality of slats;

a tilting mechanism that is adapted to be connected to the first end of the rotatable rod such that user manipulation of the tilting mechanism results in corresponding rotation of the rotatable rod within the apertures of the plurality of mounting blocks;

a vertical adjustment mechanism that is coupled to at least one of the plurality of mounting blocks so that user manipulation of the vertical adjustment mechanism results in corresponding vertical movement of the plurality of horizontal slats; and, a plurality of mounting plates that are each adapted to be separately secured to the surface of the building adjacent the window wherein each mounting block is adapted to couple with each mounting plate.

2. The apparatus of claim 1, wherein the rotatable rod is comprised of a plurality of rod sections that are interconnected by a plurality of sleeves so that an assembler can assemble the rotatable rod to differing lengths.

3. The apparatus of claim 2, wherein each of the plurality of sleeves include an opening that is adapted to receive an end of the at least one ladder assembly so that the assembler can attach the at least one ladder assembly to the rotatable rod at a plurality of different positions.

4. The apparatus of claim 3, wherein the end of the at least one ladder assembly comprises an end of a vertical ladder string that has a securing member attached thereto and wherein the openings in the sleeves include an opening through which the securing member can be positioned and a slot that in which the securing member can be captured to fixedly secure the ladder assembly to the rotatable rod.

5. The apparatus of claim 1, wherein the plurality of mounting blocks are adapted to slidably engage with the plurality of mounting plates so that the plurality of mounting blocks are mounted to the surface of the building adjacent the window.

6. The apparatus of claim 5, wherein the plurality of mounting plates define grooves and the plurality of mounting blocks define wedges such that when the wedges of the mounting blocks are positioned within the grooves of the mounting plates, the mounting blocks are retained to the surface of the building that is adjacent the window.

7. The apparatus of claim 6, wherein the grooves of the plurality of mounting plates and the wedges on the mounting blocks are oriented so that when the plates are attached to the surface, the grooves and the wedges extend in a direction that is perpendicular to the plane of the window so that the mounting blocks are slidably engaged with the mounting plates by sliding the mounting blocks in a direction that is perpendicular to the plane of the window.

8. The apparatus of claim 1, wherein the tilting mechanism is comprised of a tilting block that has an opening that contains a rotatable member that defines an aperture which receives the first end of the mounting rod, wherein the rotatable member rotates in response to user manipulation of the tilting mechanism to thereby cause the rotatable rod to rotate with respect to the plurality of mounting blocks.

9. The apparatus of claim 8, wherein the tilting mechanism includes a pulley mounted about a shaft that is rotatably mounted within the tilting block and a gear that is mounted about the pulley and is engaged with the rotatable member such that rotation of the shaft results in corresponding rotation of the rotatable member wherein at least one cord is attached to the pulley so that user induced translational movement of the cord induces the pulley and shaft to rotate thereby rotating the rotatable member and the rotatable rod.

10. The apparatus of claim 8, wherein the tilting block is adapted to be mounted to the surface of the building adjacent the window.

11. The apparatus of claim 1, wherein the vertical adjustment mechanism comprises at least one cord accessible to the user wherein at least one of the plurality of blocks includes an aperture through which the at least one cord can be inserted and wherein the at least one cord is attached to a bottom rail of the plurality of slats so that user induced translational movement of the at least one cord results in vertical movement with respect to the plurality of mounting blocks of the bottom rail and at least some of the slats interposed between the mounting blocks and the bottom rail.

12. The apparatus of claim 11, wherein the vertical adjustment mechanism includes a releasable catch mechanism that engages with the at least one cord so as to retain the plurality of slats in a desired vertical position with respect to the plurality of mounting blocks.

13. A window blind for covering a window of a building, the apparatus comprising:

a plurality of horizontal slats captured within a plurality of ladder assemblies;

a plurality of interchangeable mounting blocks that are each adapted to be separately mounted to a surface of the building adjacent the window, wherein the plurality of interchangeable blocks each defines an aperture extending therethrough;

a rotatable rod having a first and a second end wherein the rotatable rod is positioned within the apertures of the plurality of mounting blocks so as to be rotatable within the apertures when the plurality of mounting blocks are mounted to the surface of the building adjacent the window, wherein the rotatable rod is comprised of a plurality of interchangeable rod sections connected together by a plurality of connectors so that a rotatable rod of varying lengths can be assembled, wherein the plurality of ladder assemblies are connected to the rotatable rod so that the plurality of slats are positioned in front of the window and so that rotation of the rod results in lilting of the plurality of slats;

a tilting block containing a tilting mechanism that defines an aperture which receives the first end of the rotatable rod, such that user actuation of the tilting mechanism results in corresponding rotation of the rotatable rod within the apertures of the plurality of mounting blocks;

a vertical adjustment mechanism that is coupled to at least one of the plurality of mounting blocks so that user manipulation of the vertical adjustment mechanism results in corresponding vertical movement of the plurality of horizontal slats; and, a plurality of interchangeable mounting plates that are each adapted to be separately secured to the surface of the building adjacent the window wherein each mounting block is adapted to couple with each mounting plate so as to separately mount each of the mounting blocks to the surface of the building adjacent the window.

14. The apparatus of claim 13, wherein each of the plurality of sleeves include an opening that is adapted to receive an end of one of the ladder assemblies so that the assembler can attach the plurality of ladder assemblies to the rotatable rod at a plurality of different positions.

15. The apparatus of claim 14, wherein the end of each of the plurality of ladder assemblies comprises an end of a vertical ladder string that has a grommet attached thereto and wherein the openings in the sleeves include an opening through which the grommet can be positioned and a slot that in which the grommet can be captured to fixedly secure the ladder assembly to the rotatable rod.

16. The apparatus of claim 13, wherein the plurality of mounting blocks are adapted to slidably engage with the plurality of mounting plates so that the plurality of mounting blocks are mounted to the surface of the building adjacent the window.

17. The apparatus of claim 16, wherein the plurality of mounting plates define grooves and the plurality of mounting blocks define wedges such that when the wedges of the mounting blocks are positioned within the grooves of the mounting plates, the mounting blocks are retained to the surface of the building that is adjacent the window.

18. The apparatus of claim 17, wherein the grooves of the plurality of mounting plates and the wedges on the mounting blocks are oriented so that when the plates are attached to the surface, the grooves and the wedges extend in a direction that is perpendicular to the plane of the window so that the mounting blocks are slidably engaged with the mounting plates by sliding the mounting blocks in a direction that is perpendicular to the plane of the window.

19. The apparatus of claim 18, wherein the tilting block also includes a wedge that is adapted to engage with a groove on one of the plurality of mounting plates so that the tilting block can be mounted on the surface adjacent the window.

20. The apparatus of claim 13, wherein the tilting mechanism contained within the tilting block is comprised of a rotatable member positioned within an opening of the tilting block wherein the rotatable member defines an aperture which receives the first end of the mounting rod, wherein the rotatable member rotates in response to user manipulation of the tilting mechanism to thereby cause the rotatable rod to rotate with respect to the plurality of mounting blocks.

21. The apparatus of claim 20, wherein the tilting mechanism includes a pulley mounted about a shaft that is rotatably mounted within the tilting block and a gear that is mounted about the pulley and is engaged with the rotatable member such that rotation of the shaft results in corresponding rotation of the rotatable member wherein at least one cord is attached to the pulley so that user induced translational movement of the cord induces the pulley and shaft to rotate thereby rotating the rotatable member and the rotatable rod.

22. The apparatus of claim 13, wherein the vertical adjustment mechanism comprises at least one cord accessible to the user wherein each of the plurality of blocks includes an aperture through which the at least one cord can be inserted and wherein the at least one cord is attached to a bottom rail of the plurality of slats so that user induced translational movement of the at least one cord results in vertical movement with respect to the plurality of mounting blocks of the bottom rail and at least some of the slats interposed between the mounting blocks and the bottom rail.

23. The apparatus of claim 22, wherein the vertical adjustment mechanism includes a releasable catch mechanism that engages with the at least one cord so as to retain the plurality of slats in a desired vertical position with respect to the plurality of mounting blocks.

24. The apparatus of claim 13, further comprising at least one decorative member that is adapted to slidably engage with the plurality of mounting blocks so as to be secured thereto.

25. The apparatus of claim 24, wherein the plurality of mounting blocks have a plurality of wedges formed thereon that are adapted to be positioned within a groove formed in the at least one decorative member.

26. A method of assembling a window blind apparatus for covering a window of a building, the method comprising:

separately mounting each of a plurality of mounting blocks to a surface of the building adjacent the window;

positioning a rotatable rod through an aperture of each mounting block so that the rotatable rod is rotatable within the apertures of the plurality of mounting blocks and so that the rotatable rod is supported by the plurality of mounting blocks;

attaching a plurality of slats captured within a ladder assembly to the rotatable rod;

attaching a tilting mechanism to a first end of the rotatable rod so that user manipulation of the tilting mechanism results in rotation of the rotatable rod with respect to the mounting blocks thereby causing the plurality of slats to tilt;

attaching a vertical adjustment mechanism to at least one of the mounting blocks and to the plurality of slats so that user actuation of the vertical adjustment mechanism results in vertical movement of the plurality of slats with respect to the mounting blocks; and, separately mounting each of a plurality of mounting blocks to a surface of the building adjacent the window comprises: separately attaching each of a plurality of mounting plates to a surface of the building located adjacent the window; and slidably engaging each of the mounting blocks with each of the mounting plates so that the mounting blocks are mounted to the surface of the building located adjacent the window and the plurality of slats are positioned in front of the window.

27. The method of claim 26, wherein attaching a tilting mechanism to a first end of the rotatable rod comprises positioning the first end of the rotatable rod within an aperture of a tilting block containing the tilting mechanism.

28. The method of claim 26, wherein attaching a vertical adjustment mechanism to at least one of the mounting blocks and to the plurality of slats comprises threading a vertical adjustment cord through an aperture in the mounting block and then attaching the cord to a bottom slat.

29. The method of claim 26, wherein attaching the plurality of slats captured within a ladder assembly to the rotatable rod comprises positioning at least one outer ladder string in an opening formed in the sleeves interconnecting the rod sections of the rotatable rod.

30. The method of claim 26, wherein slidably engaging the mounting blocks with the mounting plates comprises positioning a wedge formed on each of the mounting blocks into a groove formed on the mounting plates.

31. The method of claim 30, wherein positioning the wedge formed on each of the mounting blocks into a groove formed on the mounting plate comprises sliding the wedges into the grooves in a direction that is perpendicular to the plane of the window.

32. The method of claim 31, further comprising mounting a decorative member over an exposed surfaces of the plurality of mounting blocks.

* * * * *